US005457361A

United States Patent [19]

Nakata et al.

[11] Patent Number: 5,457,361

[45] Date of Patent: Oct. 10, 1995

[54] ION REMOVING DEVICE, ION REMOVING METHOD AND ELECTRON ACCUMULATING RING HAVING ION REMOVING DEVICE

[75] Inventors: Shuhei Nakata; Hirofumi Tanaka; Itsuo Kodera; Tetsuya Nakanishi, all of Amagasaki, Japan

[73] Assignee: Mitsubishi Denki Kabushiki Kaisha, Tokyo, Japan

[21] Appl. No.: 15,125

[22] Filed: Feb. 9, 1993

[30] Foreign Application Priority Data

Feb. 17, 1992 [JP] Japan ..... 4-029576
Jul. 21, 1992 [JP] Japan ..... 4-193566

[51] Int. Cl.[6] ..... H05H 13/00

[52] U.S. Cl. ..... 315/500; 315/501; 315/502; 315/503; 315/504

[58] Field of Search ..... 328/227, 228, 328/229, 230, 233, 235, 237; 313/361.1; 315/500, 501, 502, 503, 504

[56] References Cited

U.S. PATENT DOCUMENTS 4,808,941 2/1989 Marsing ..... 328/235
4,916,404 4/1990 Tsumaki et al. ..... 328/233

FOREIGN PATENT DOCUMENTS 64-33200 3/1989 Japan .

OTHER PUBLICATIONS

"High–Energy Accelerator Seminar"; High Energy Physics Association; No. VI, p. 17; 1986.
S. Sugiyama, et al "Ion Clearing At Teras" The 6th Symp. on Accelerator Science & Technology, 1987, Tokyo, Japan.

*Primary Examiner*—Donald J. Yusko
*Assistant Examiner*—N. D. Patel
*Attorney, Agent, or Firm*—Wolf, Greenfield & Sacks

[57] ABSTRACT

An ion removing device includes an ion inducing electrode provided in a vacuum container in a deflection portion of an electron accumulating ring along an inner peripheral wall of the vacuum container, an ion removing electrode provided in the vacuum container near each of ports of the defection portion of the electron accumulating ring, and a power source for applying a voltage to both the ion inducing electrode and the ion removing electrodes. An ion removing method includes the steps of inducing ions trapped by a potential generated by an electron beam to ports of a deflection portion of an electron accumulating ring by forming an electric field in a vacuum container in the deflection portion, and removing the ions which have been inducted to the ports of the defection portion. An electron accumulating ring includes a vacuum container for retaining electrons in a vacuum, a deflection electromagnet provided around the vacuum container located in a deflection portion for generating a magnetic field to deflect an electron beam, an ion inducing electrode provided in the vacuum container located in the deflection portion along an inner peripheral wall of the vacuum container, an ion removing electrode provided in the vacuum container at each of ports of the deflection portion, and a power source for applying a voltage to both the ion inducing electrode and the ion removing electrodes.

7 Claims, 7 Drawing Sheets

ION REMOVING DEVICE, ION REMOVING METHOD AND ELECTRON ACCUMULATING RING HAVING ION REMOVING DEVICE

BACKGROUND OF THE INVENTION

1. Field of the Invention

The present invention relates to a device for removing ions in an electron accumulating ring, as well as a method thereof. The present invention also pertains to an electron accumulating ring having an ion removing device.

2. Description of the Related Art

FIG. 7 is a cross-sectional view of the essential parts of a conventional electron accumulating ring which has been introduced in, for example, proceedings of the 6th symposium on Accelerator Science and Technology held from Oct. 27th to 29th in 1987 in Tokyo on page 265 by Sugiyama and others. In the figure, reference numeral 1 denotes a vacuum container; 2 denotes a wire-like ion removing electrode provided in the vacuum container 1 to induce electrons and thereby take out ions to the outside of the ring in order to increase the life of the electrons in the vacuum container 1; 3 denotes a deflection electromagnet provided around the vacuum container 1 to generate a magnetic field in a vertical direction in order to curve electrons in a horizontal direction; 4 denotes the direction of the magnetic field; and 5 denotes the direction of an electric field. The electron accumulating ring further includes a quadrupole electromagnet provided around the vacuum container 1 to stabilize the electron orbits, and a high-frequency accelerating space for accelerating electrons, which are not shown.

In the conventional electron accumulating ring arranged in the manner described above, when a high voltage is applied to the ion removing electrode 2, an electric field is generated in direction indicated by arrows 5. Because of the generated electric field and magnetic field, the ions at the central portion perform drift motion. The direction of the drift motion is directed toward this side and in a direction perpendicular to the paper, whereby they can be taken out to the outside of the deflection electromagnet 3.

However, in the electron accumulating ring having a racetrack-like shape, the beam diameter in the horizontal direction is at a minimum near the center of the deflection electromagnet which surrounds the ring over 180°. Generally, the position where the beam diameter is at a minimum is the position where the potential as seen from ions is the lowest, and the ions are trapped at that trough of the potential. FIG. 8 is a graph showing the potential generated by the charged particles which circulate the accumulating ring. In FIG. 8, the abscissa axis represents the distance in the axial direction of a beam, and the coordinate axis represents the potential. As can be seen from FIG. 8, the potential as seen from the ions is the lowest near the center of the deflection electromagnet which surrounds the ring over 180°. Ions are trapped at that position.

Thus, it is impossible for the ion removing electrode 2 shown in FIG. 7 to take out the trapped ions to the outside of the deflection electromagnet 3.

Hence, the ion removing device shown in FIG. 9 has been proposed. The device shown in FIG. 9 has been described "High-Energy Accelerator Seminar" published by High-Energy Physics Association No. VI on page 17. In the figure, reference numeral 6 denotes an ion removing electrode; 7 denotes a vacuum container; and 8 denotes an electron beam.

In the ion removing device arranged in the manner described above, when the ions trapped by the potential of the electron beam 8 are present near the ion removing device, a voltage of several hundreds of volts is applied to the ion removing electrodes 6. Consequently, the ions in the vacuum container 7 constituting the electron accumulating ring move away from the potential of the electron beam 8 toward the ion removing electrodes 6. Those ions disappear at the ion removing electrodes 6. Thus, the ions in the electron accumulating ring can be removed.

However, it is difficult to provide the ion removing electrodes 6 in such a manner that they are separated in the vertical direction at the center of the deflection electromagnet, as shown in FIG. 9, because the portion of the vacuum container 7 which is located in the deflection portion is generally manufactured as one unit to obtain a super high vacuum. Furthermore, since the diameter of the electron beam in the vertical direction is at a maximum at the center of the deflection portion, the provision of the ion removing electrodes 6 in the vertical direction may prohibit stable circulation of the electron beam. Also, when the ion removing electrodes 6 are provided in the vertical direction, since the electrodes are located close to the electron beam, stable circulation of the electron beam may be prohibited due to the wake generated by the electron beam.

In order to solve the above-described problems, the ion removing electrodes 6 may be provided in such a manner that they are separated in the horizontal direction of the vacuum container 7. However, in that case, when an electric field is applied in the horizontal direction in the high magnetic field of the deflection electromagnet to remove the ions, the ions may perform drift motion in the axial direction of the beam but not be removed efficiently.

In the above-described conventional ion removing device, since the ion removing electrodes 6 are provided in the vacuum container 7 in the vertical direction, the vertical aperture of the orbit of the electron beam is narrowed, thus making stable circulation of the electrons impossible.

Furthermore, the portion of the vacuum container 7 which is located in the defection electromagnet is manufactured as one unit in order to obtain a super-high vacuum. It is therefore difficult to firmly mount the ion removing electrodes 6 in the deflection electromagnet in such a manner that they are separated in the vertical direction. Where the ion removing electrodes 6 are provided such that they extend over 180°, they may be fixed at the exits of the two ends of the deflection electromagnet. However, it is impossible to fix the ion removing electrodes 6 in the inside of the deflection electromagnet at the central portion thereof, and this makes it impossible to specify the position of the ion removing electrodes 6 in the deflection electromagnet after the deflection electromagnet has been incorporated.

SUMMARY OF THE INVENTION

Accordingly, an object of the present invention is to provide an ion removing device which is capable of removing ions efficiently without narrowing the vertical aperture of an electron beam, as well as an ion removing method thereof.

Another object of the present invention is to provide an electron accumulating ring which incorporates such an ion removing device.

In order to achieve the above objects, according to one aspect of the present invention, there is provided an ion removing device which comprises an ion inducing electrode provided in a vacuum container in a deflection portion of an electron accumulating ring along an inner peripheral wall of the vacuum container, an ion removing electrode provided in the vacuum container near each of ports of the deflection portion of the electron accumulating ring, and a power source for applying a voltage to both the ion inducing electrode and the ion removing electrodes.

According to another aspect of the present invention, there is provided an ion removing method which comprises the steps of inducing ions trapped by a potential generated by an electron beam to ports of a deflection portion of an electron accumulating ring by forming an electric field in a vacuum container in the deflection portion, and removing the ions which has been inducted to the ports of the deflection portion.

According to another aspect of the present invention, there is provided an electron accumulating ring which comprises a vacuum container for retaining electrons in a vacuum, a deflection electromagnet provided around the vacuum container located in a deflection portion for generating a magnetic field to deflect an electron beam, an ion inducing electrode provided in the vacuum container located in the deflection portion along an inner peripheral wall of the vacuum container, an ion removing electrode provided in the vacuum container at each of ports of the deflection portion, and a power source for applying a voltage to both the ion inducing electrode and the ion removing electrodes.

DESCRIPTION OF THE PREFERRED EMBODIMENTS

Embodiments of the present invention will be described below with reference to the accompanying drawings.

Figure 1:
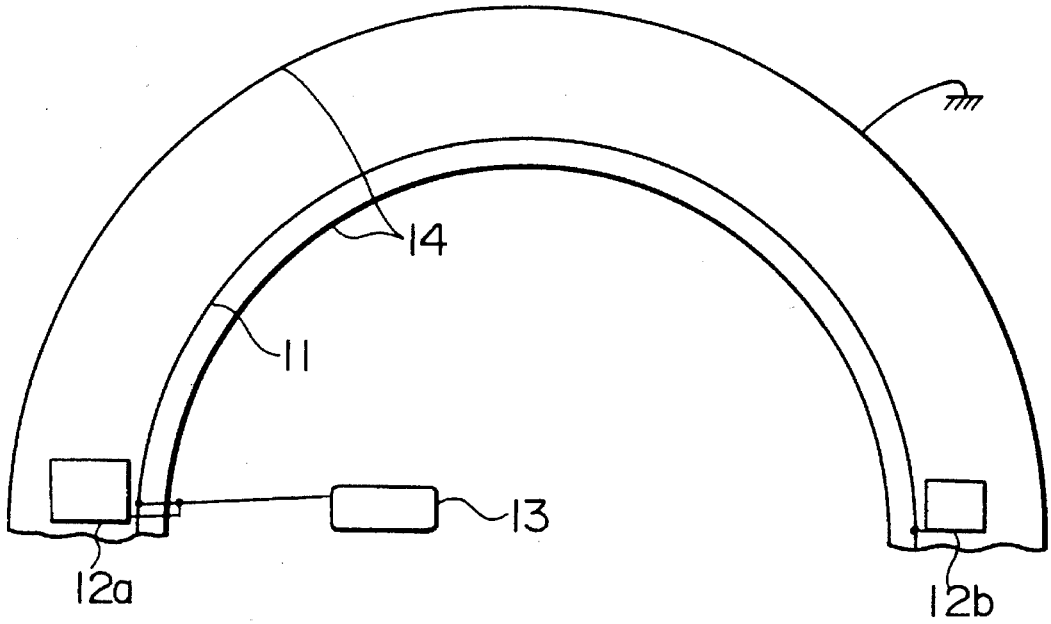
FIG. 1 is a plan view of the vicinity of a deflection portion of an electron accumulating ring with an ion removing device incorporated therein showing a first embodiment of the present invention.

First Embodiment:

FIG. 1 shows the portion of an electron accumulating ring which is located near the deflection portion according to a first embodiment of the present invention. An ion inducing electrode 11 is provided in a vacuum container 14 over the entire deflection portion of the electron accumulating ring. The ion inducing electrode 11 is disposed along the vacuum container 14 on the inner peripheral side thereof. Also, ion removing electrodes 12*a* and 12*b* are provided in the lower portion of the vacuum container 14 at the inlet and exit of the deflection portion, respectively. The ion inducing electrode 11 and the ion removing electrodes 12*a* and 12*b* are all connected to a high-voltage power source 13. The vacuum container 14 is grounded.

The operation of the first embodiment will now be described. It is assumed that ions are trapped by the potential generated by the electron beam in the deflection portion where the deflection electromagnet (not shown) is provided. First, a d.c. voltage of about 10 KV is applied to the ion inducing electrode 11 from the power source 13 to generate an electric field in the portion of the vacuum container 14 which is located near the deflection portion. The same d.c. voltage is also applied to the ion removing electrodes 12*a* and 12*b*.

Figure 2:
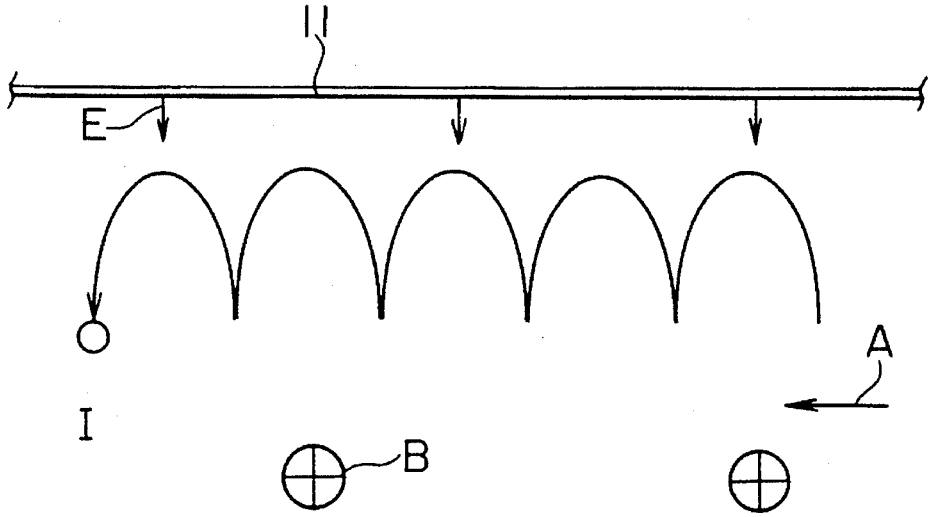
FIG. 2 illustrates how an ion is inducted in the first embodiment.

How the ions are induced by an electric field E formed by the ion inducing electrode 11 is shown in FIG. 2. An ion I performs a E×B drift motion due to the action of both the electric field E and a magnetic field formed by the deflection electromagnet, and is thus induced in an axial direction A of the electron orbit. The ion I which has been induced to the end portion of the deflection portion is removed by the ion removing electrodes 12*a* and 12*b* disposed in the lower portion of the vacuum container 11.

Thus, in the first embodiment, the ions trapped by the potential of the electron beam can be efficiently removed by generating an electric field by the ion inducing electrode 11 in the portion of the vacuum container 14 which is located near the deflection portion.

Furthermore, in the first embodiment, since it is not necessary for the ion removing electrodes to be disposed in the vertical direction in the portion of the vacuum container located near the deflection portion, unlike the conventional device, the electron beam can be stably moved without the aperture narrowed.

Furthermore, since the ion inducing electrode 11 and the ion removing electrodes 12*a* and 12*b* are electrically conducted so that a voltage can be applied thereto by a single high-voltage power source 13, the cost of the device can be reduced.

Figure 3:
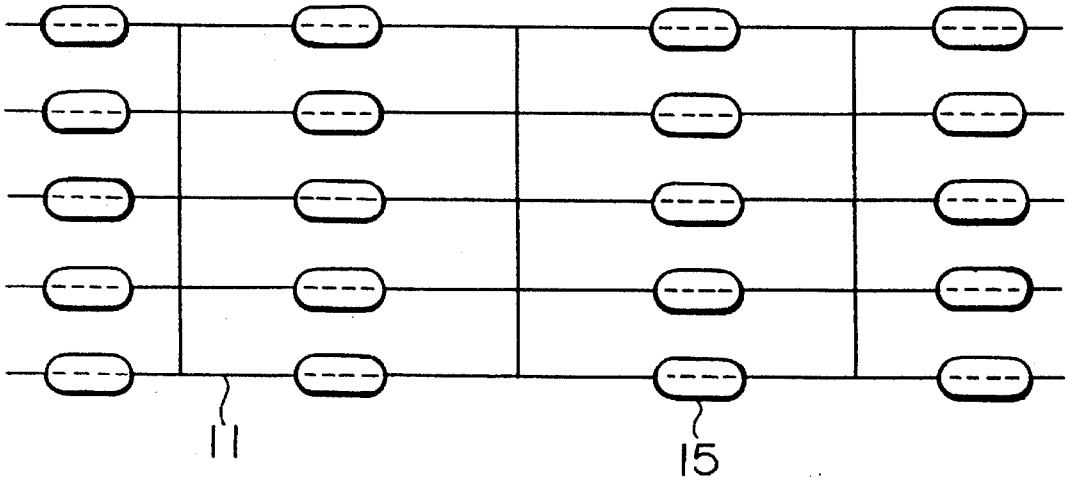
FIG. 3 is a plan view of an ion inducing electrode of the first embodiment.

The structure of the ion inducing electrode 11 employed in the first embodiment will be described below in detail. As shown in FIG. 3, the ion inducing electrode 11 is made up of copper or stainless wires each having a cross-sectional area of a few $mm^2$ and connected in the form of, for example, a lattice. It is not always necessary to use wires. However, if wires are used, the weight of the ion inducing electrode 11 can be reduced, and the manufacture thereof can be made easy. A plurality of fixing members 15 made of an electrically insulating material, such as a ceramic, are coated on the wires to allow the ion inducing electrode 11 to be fixed to the inner wall of the vacuum container 14 and to provide an electrical insulation between the wires to which a high-voltage is applied from the power source 13 and the vacuum container 14.

Figure 4:
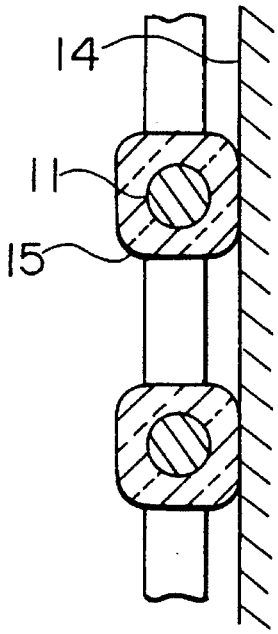
FIG. 4 is a cross-sectional view of the ion inducing electrode fixed to a vacuum container in the first embodiment.

As shown in FIG. 4, each of the fixing members 15 is fixed to the inner peripheral wall surface of the portion of the vacuum container 14 which is located in the deflection portion. When an electron accumulating ring is to be manufactured, after the portion of the vacuum container 14 which is located in the deflection portion has been completed, the ion inducing electrode 11 is inserted into the vacuum container 14 from the port of the deflection portion, and is then pulled from the two ports of the deflection portion to press the fixing members 15 against the inner peripheral wall of the vacuum container 14. Thereafter, the ion inducing electrode 11 is threaded to the vacuum container 14 at the two port of the deflection portion.

Since the threading of the ion inducing electrode 11 to the vacuum container 14 is performed only at the two ports of the deflection portion and since the wires of the ion inducing electrode 11 are pressed against the inner peripheral wall of the vacuum container 14 with the fixing members 15 therebetween in the deflection portion, as mentioned above, assembly and fixing of the electrode 11 are simplified.

In addition, the corners of each of the fixing members 15 is rounded. Therefore, the creeping distance between the ion inducing electrode 11 and the vacuum container 14 is increased, thus preventing generation of discharge between these components.

A metal plate-like electrode may be used as the ion removing electrodes 12*a* and 12*b*. Alternatively, the ion removing electrodes 12*a* and 12*b* may be made of a wire, like the ion inducing electrode 11. The ion removing electrodes 12*a* and 12*b* may also be disposed in the vacuum container 14 in upper portion thereof at the ports of the deflection portion.

Second Embodiment

Figure 5:
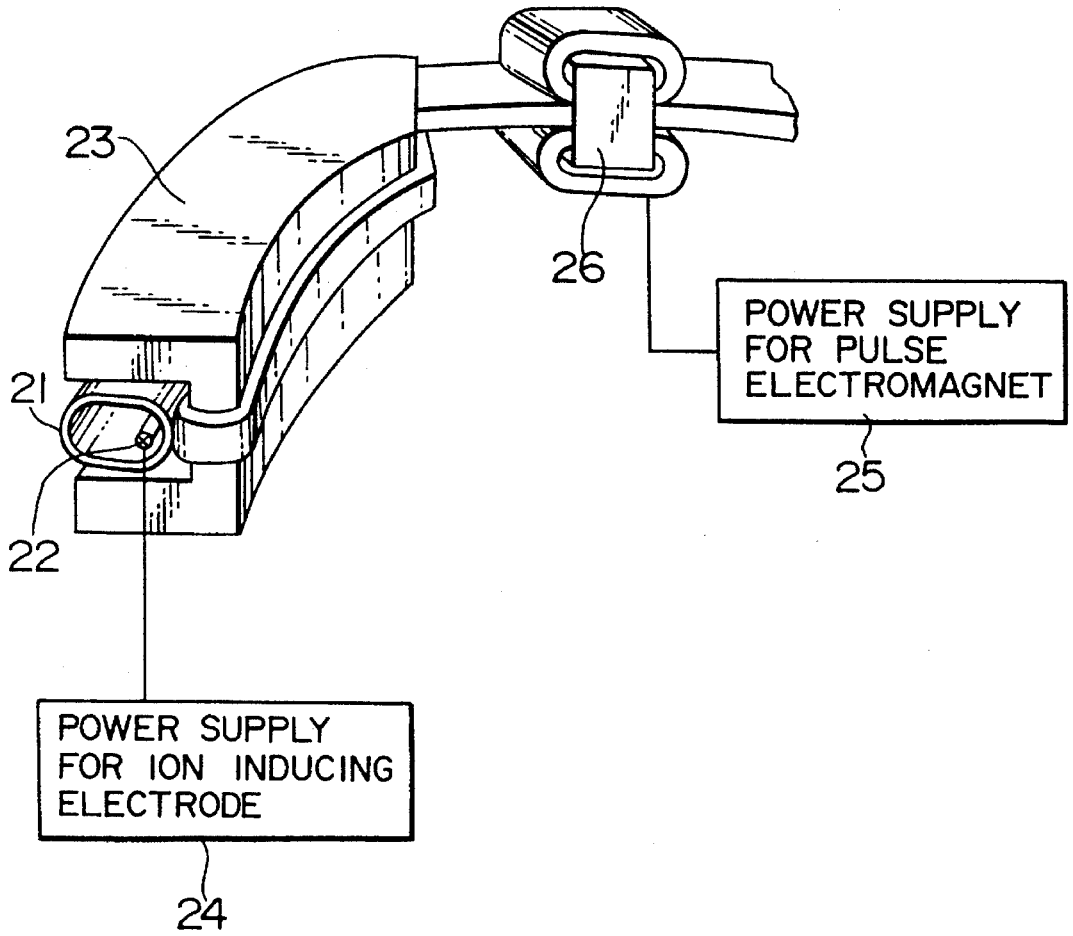
FIG. 5 is a perspective view of the essential parts of the electron accumulating ring showing a second embodiment of the present invent ion.

FIG. 5 shows the essential parts of the electron accumulating ring according to a second embodiment of the present invention. A deflection electromagnet 23 is provided in the deflection portion of the ring, and an ion inducing electrode 22 made of a wire is provided in the portion of a vacuum container 21 which is located in the deflection portion. The ion inducing electrode 22 is disposed along the vacuum container 21. A pulse electromagnet 26 is provided near the end portion of the deflection portion such that it encloses the vacuum container 21. Power sources 24 and 25 are connected to the ion inducing electrode 22 and the pulse electromagnet 26, respectively.

Figure 6:
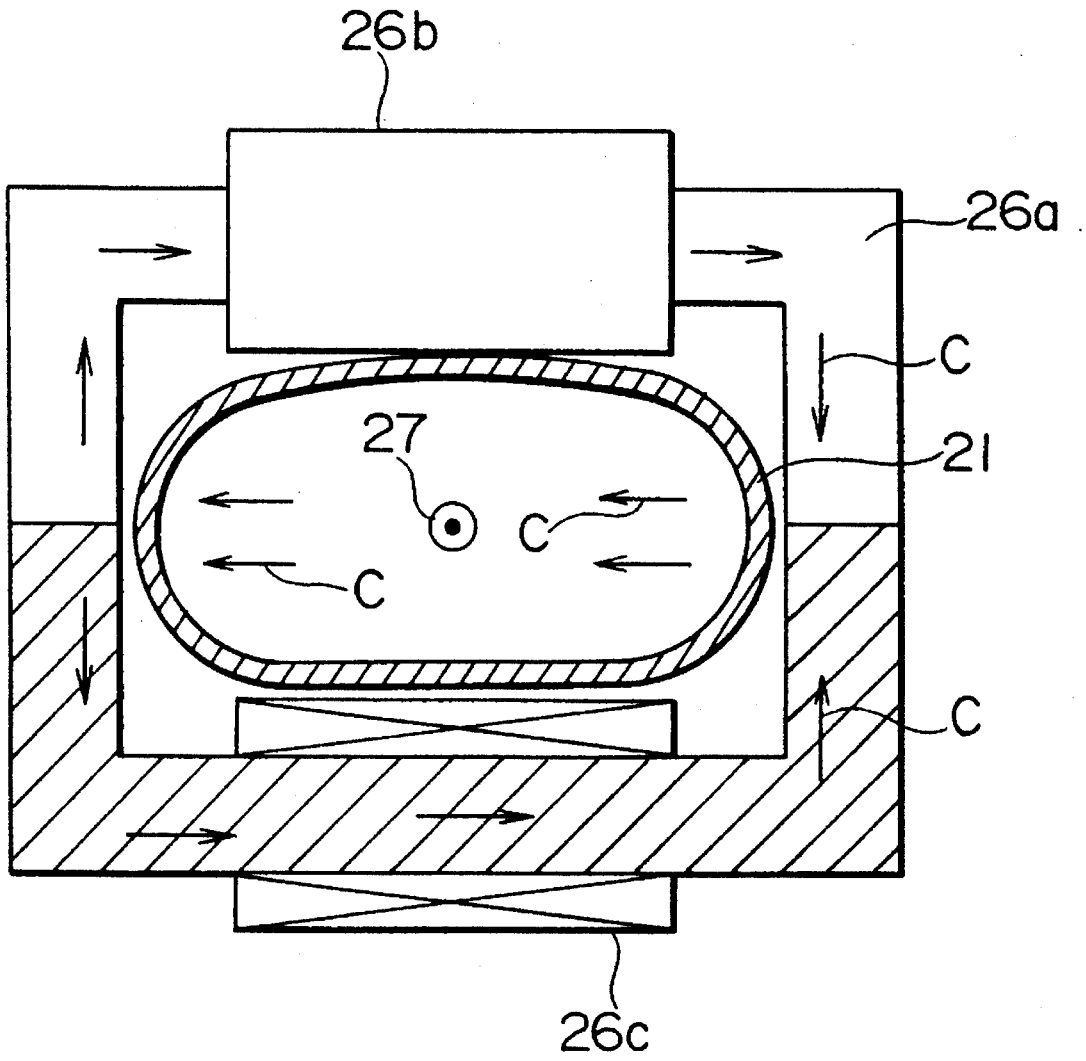
FIG. 6 is a front view ,with parts broken away, of a pulse electromagnet employed in the second embodiment.
Figure 7:
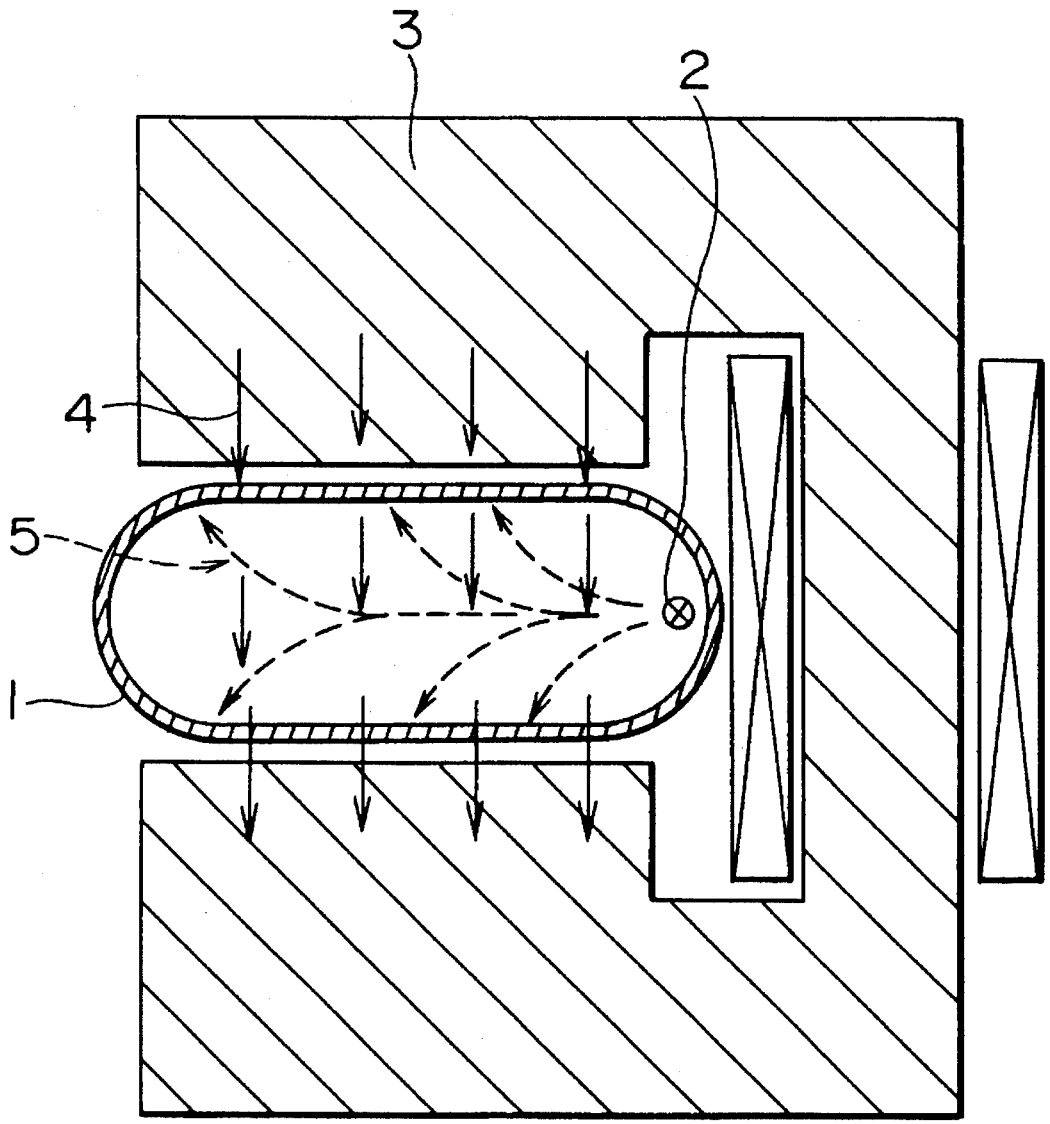
FIG. 7 (PRIOR ART)
FIG. 7 is a cross-sectional view of the essential parts of a conventional electron accumulating ring.
Figure 8:
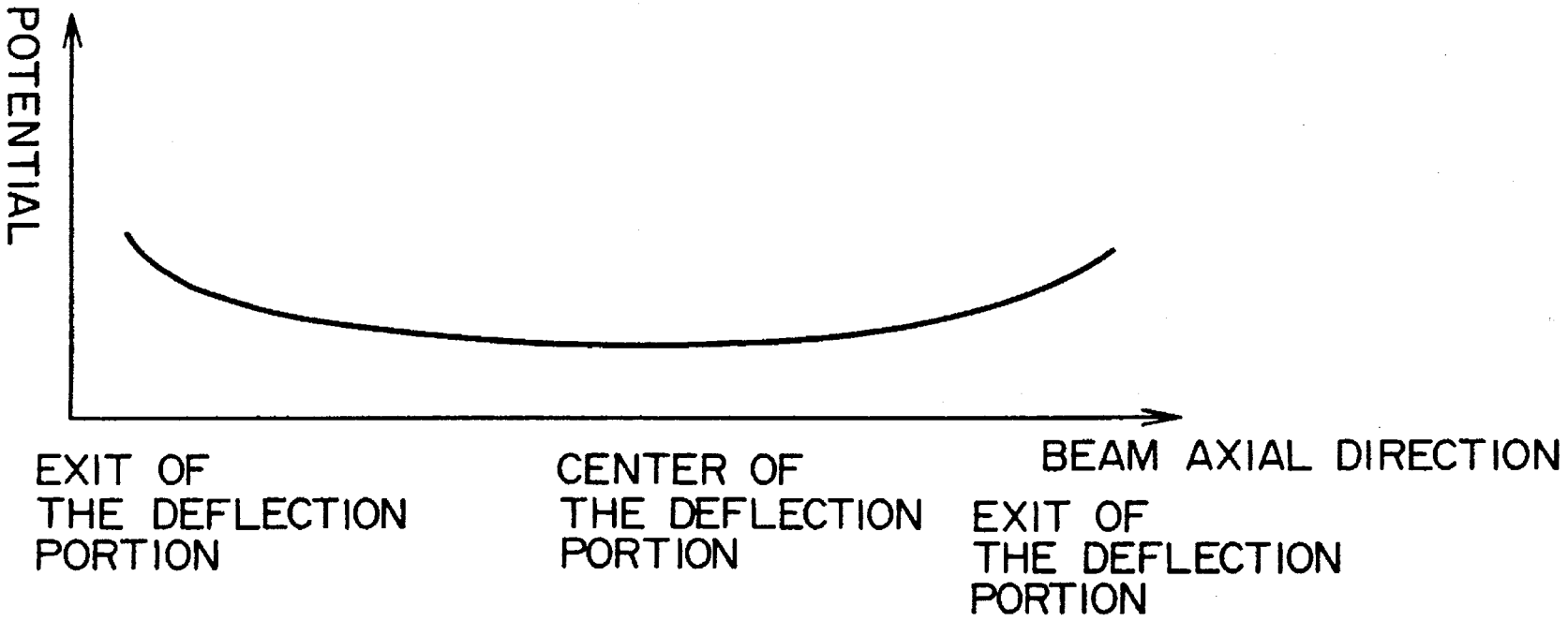
FIG. 8 is a graph showing the potential formed by charged particles which circulate the electron accumulating ring.
Figure 9:
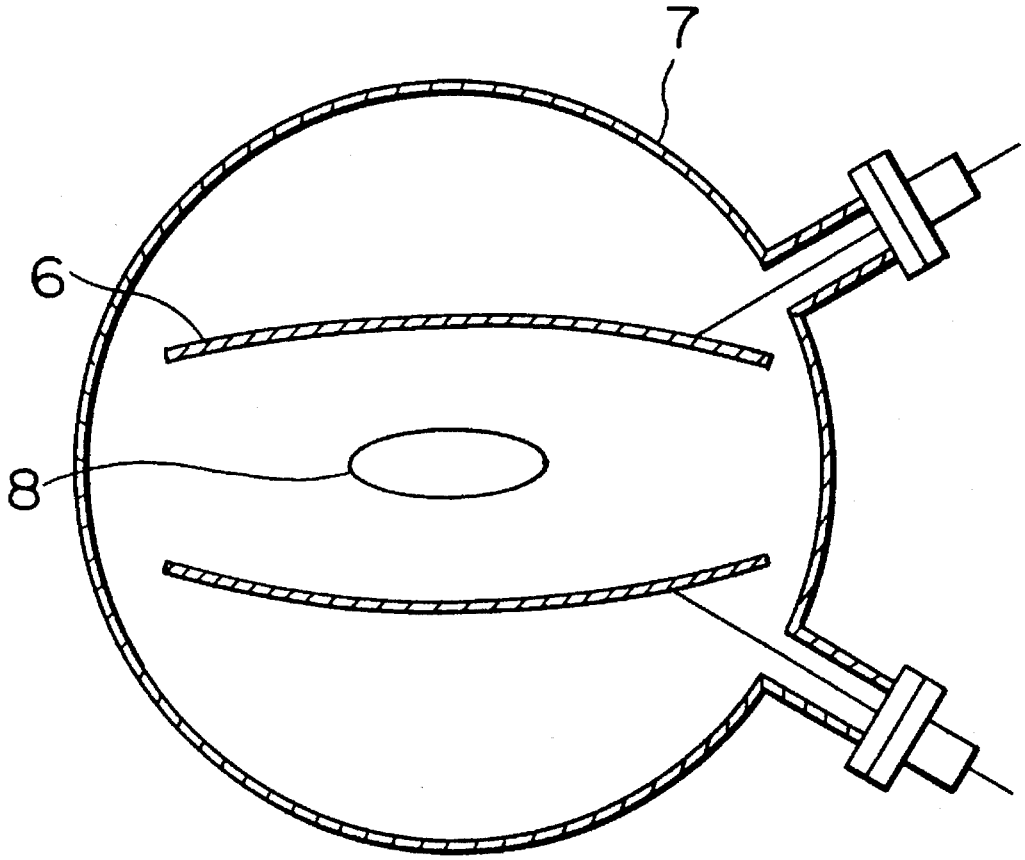
FIG. 9 (PRIOR ART)
FIG. 9 is a cross-sectional view of a conventional ion removing device.

As shown in FIG. 6, the pulse electromagnet 26 includes a window frame type ferromagnetic member 26*a* which surrounds the vacuum container 21, a first coil 26*b* wound around the upper portion of the ferromagnetic member 26*a*, and a second coil 26*c* wound around the lower portion thereof.

The operation of the second embodiment will be described below. An electric field is generated in the vacuum container 21 by applying a high voltage to the ion inducing electrode 22 provided in the portion of the vacuum container 21 which is located in the deflection portion from the power source 24. Ions perform E×B drift motion due to the action of both the electric field and a magnetic field formed by the deflection electromagnet 23, and are thus inducted in the axial direction of the electron beam orbit. However, a trough of the potential generated by the electrons may be formed in the deflection portion, and ions may be trapped in that trough. Formation of the trough depends on the shape of the deflection electromagnet 23.

Hence, a pulse-like exciting current is supplied from the power source 25 to the first and second coils 26*b* and 26*c* of the pulse electromagnet 26 to generate a magnetic field, as shown by arrows C in FIG. 6. Consequently, the orbit of an electron beam 27 is pulsatively deflected upward, as viewed in FIG. 6, and thereby moved closer to the inner wall surface of the vacuum container 21. That is, a trough of the potential generated by the electron beam 27 is formed not in the deflection portion but in the vicinity thereof: in the deflection portion where the deflection electromagnet 23 is disposed is formed a crest of the potential. Therefore, the ions trapped in the deflection portion perform E×b drift motion due to the action of the electric field formed by the ion inducing electrode 22 and the magnetic field formed by the deflection electromagnet 23, and are thus inducted and taken out efficiently to the outside of the deflection portion.

When the exciting current supplied to the pulse electromagnet 26 from the power source 25 is reversed, the orbit of the electron beam 27 is deflected downward as viewed in FIG. 6, and thus moved toward the inner wall surface of the vacuum container 21.

A pulse-like exciting current may be cyclically applied to the pulse electromagnet 26 from the power source 25.

What is claimed is:

1. An ion removing device for removing ions in a vacuum container of an electron accumulating ring; said device comprising:

an ion inducing electrode provided in said vacuum container in a deflection portion of said electron accumulating ring along an inner peripheral wall of said vacuum container;

an ion removing electrode provided within said vacuum container near each of ports of said deflection portion of said electron accumulating ring; and a power source for applying a voltage to both said ion inducing electrode and said ion removing electrodes.

2. An ion removing device according to claim 1 wherein said ion inducing electrode is formed of a wire.

3. An ion removing device according to claim 2 wherein said ion inducing electrode is formed by connecting the wire in the form of a lattice.

4. An ion removing device according to claim 3 further comprising a plurality of fixing members mounted on the wire which forms said ion inducing electrode for providing an electric insulation between the wire and said vacuum container and for fixing the wire to said vacuum container.

5. An ion removing device according to claim 4 wherein two ends of said ion inducing electrode are fixed to said vacuum container at the ports of said deflection portion of said electron accumulating ring, whereby said ion inducing electrode is pressed against to the inner peripheral wall of said vacuum container with said plurality of fixing members therebetween in an inside of said deflection portion.

6. An ion removing method comprising the steps of:

inducing ions trapped by a potential generated by an electron beam to ports of a deflection portion of an electron accumulating ring by forming an electric field in a vacuum container in said deflection portion; and removing the ions which has been inducted to the ports of said deflection portion.

7. An electron accumulating ring comprising:

a vacuum container for retaining electrons in a vacuum;

a deflection electromagnet provided around said vacuum container located in a deflection portion for generating a magnetic field to deflect an electron beam;

an ion inducing electrode provided in said vacuum container located in said deflection portion along an inner peripheral wall of said vacuum container;

an ion removing electrode provided in said vacuum container at each of ports of said deflection portion; and a power source for applying a voltage to both said ion inducing electrode and said ion removing electrodes.

* * * * *